United States Patent [19]

Nasatka et al.

[11] Patent Number: 4,818,136

[45] Date of Patent: Apr. 4, 1989

[54] HYDRAULIC VEHICLE BARRICADE AND METHOD

[76] Inventors: Ralph G. Nasatka, 8405 Dangerfield Pl., Clinton, Md. 20735; Michael Lippy, 12032 Forbes Glen Dr., Herndon, Va. 22070

[21] Appl. No.: 43,977

[22] Filed: Apr. 29, 1987 (Under 37 CFR 1.47)

[51] Int. Cl.[4] ..... E01F 13/00

[52] U.S. Cl. ..... 404/6; 49/33; 49/49

[58] Field of Search ..... 404/6; 49/33, 49, 131, 49/133; 244/110 C, 110 F

[56] References Cited

U.S. PATENT DOCUMENTS

| | | | |
|---|---|---|---|
| 2,362,912 | 11/1944 | Logan, Jr. | 49/49 X |
| 3,724,333 | 4/1973 | Fonden et al. | 244/110 F |
| 3,869,104 | 3/1975 | Gallo | 244/110 C |
| 3,884,262 | 5/1975 | Assembergs | 137/115 X |
| 4,152,871 | 5/1979 | Kendash, Jr. | 49/49 |
| 4,396,037 | 8/1983 | Wilcox | 251/129.03 X |
| 4,490,068 | 12/1984 | Dickinson | 404/6 |
| 4,574,523 | 3/1986 | Nasatka | 49/49 |
| 4,711,608 | 12/1987 | Ghusn | 404/6 |

FOREIGN PATENT DOCUMENTS

| | | | |
|---|---|---|---|
| 983441 | 2/1965 | United Kingdom | 404/6 |

OTHER PUBLICATIONS

Panker Hannifin, Fluid Power, Design Engineers Handbook (1973), pp. a-3 through a-6.

Panker-Hannifin Corp., Fluid Power (1977), pp. 2-1 to 2-7, 9-1 to 9-10, 11-1 to 11-9.

Womsck Educational Publications, Industrial Fluid Power Text, vol. 2 (1972), pp. 155, 162-174.

*Primary Examiner*—Jerome W. Massie, IV
*Assistant Examiner*—Matthew Smith
*Attorney, Agent, or Firm*—Shlesinger, Arkwright & Garvey

[57] ABSTRACT

A hydraulic barricade comprising a support to which a barricade plate is pivotally attached. At least a first hydraulic cylinder and piston assembly is operably connected with the barricade plate for pivoting the barricade plate between an up and a down position. A pump supplies pressurized hydraulic fluid to a primary source and a secondary source of pressurized fluid. A directional control valve is interposed between the cylinder and piston assembly and the sources for causing operation of the cylinder and piston assembly and thereby pivoting of the barricade plate. A first check valve is interposed between the sources for permitting pressurized fluid to flow from the pump and the cylinder and piston assembly to the secondary source and for preventing fluid from flowing from the secondary source to the primary source. The secondary source includes an hydraulic accumulator for storing hydraulic fluid under pressure. An emergency valve is interposed between the secondary source and the directional control valve for supplying fluid from the accumulator to the directional control valve and the emergency valve includes a manual/remote operator for permitting selective operation thereof.

22 Claims, 3 Drawing Sheets

HYDRAULIC VEHICLE BARRICADE AND METHOD

BACKGROUND OF THE INVENTION

The prevention of unauthorized entry of vehicles to a facility has increased in importance in the recent past. For example, recent experience has indicated that terrorists will crash an explosives laden vehicle into a building in order to cause destruction of same. The primary defense against such attacks is a barricade which effectively stops the oncoming vehicle at a safe distance from the building. The barricade chosen must be movable in order to permit authorized entry, while preventing unauthorized entry.

Numerous barricades have been proposed for preventing unauthorized access to a facility by transit along a roadway. Generally, such barricades include a barrier plate which is pivotal between an extended position and a lowered passage position. The barrier plate is usually pivoted by mechanical mechanism, such as an hydraulic cylinder and piston.

As noted, the barrier should permit authorized access, while preventing unauthorized access through rapid pivoting into the extended position. Should the plate not pivot quickly enough, then the onrushing vehicle may obtain access. Furthermore, the observation booth is frequently remote from the barricade and it is therefore necessary that the barrier be remotedly operated. Furthermore, operation of the barrier in any one of a number of various emergency conditions which may arise must be assured.

The disclosed invention is an hydraulic barricade and method which is operable through a primary active motive force, as well as through a secondary passive motive force. The secondary source is activated through a valve having a manual/remote operator to permit pivoting in an emergency situation, such as loss of power, loss of fluid or terrorist attack. Regardless of the condition, the disclosed hydraulic barricade may be rapidly operated by either of the sources in order to effectively stop the oncoming vehicle.

OBJECTS AND SUMMARY OF THE INVENTION

The primary object of the disclosed invention is an hydraulic vehicle barricade and method utilizing a primary active source of hydraulic fluid, as well as a secondary passive source operable in emergency situations.

The hydraulic barricade of the invention includes a support to which a barricade plate is pivotally attached. At least a first hydraulic cylinder and piston assembly is operably connected with the barricade plate for pivoting the barricade plate between an up and a down position. An hydraulic pump supplies pressurized hydraulic fluid for a primary source and to a secondary source of fluid. A directional control valve is interposed between the cylinder and piston assembly and the sources and operates the cylinder and piston assembly and thereby controls pivoting of the barricade plate. A first check valve is interposed between the sources and permits pressurized fluid to flow from the pump and the cylinder and piston assembly to the secondary source and prevents fluid from flowing from the secondary source to the primary source. An hydraulic accumulator stores hydraulic fluid under pressure as part of the secondary source. An emergency valve is interposed between the secondary source and the directional control valve and supplies fluid from the accumulator to the directional control valve. The emergency valve includes a manual/remote operator permitting selective operation of the barricade plate.

The hydraulic system of the invention incorporates two independent, yet interlaced, systems into one compact unit. A positive displacement pump generates a primary fluid flow of sufficient pressure to raise and lower the barrier plate, the primary fluid flow being controlled by a solenoid operated directional control valve. Full pump output is utilized during normal operation and, therefore, no hydraulic restrictions, such as flow control valves and the like, are required, thereby avoiding sources of heat generation.

A secondary system utilizes an hydraulic accumulator to generate and maintain an independent source of hydraulic potential energy sufficient to operate the barrier plate for numerous cycles of operation. The reserve source is automatically made available to the barricade system in the event of primary system failure, such as caused by emergency condition or power failure. The reserve system is activated only during emergency condition, so that the secondary system remains totally passive unless an emergency occurs. The changeover from the primary to the secondary system is totally transparent to the operator and requires no intervention. When the emergency condition has been cleared or corrected, then the hydraulic system returns to the primary operating mode and the reserve system is replenished.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
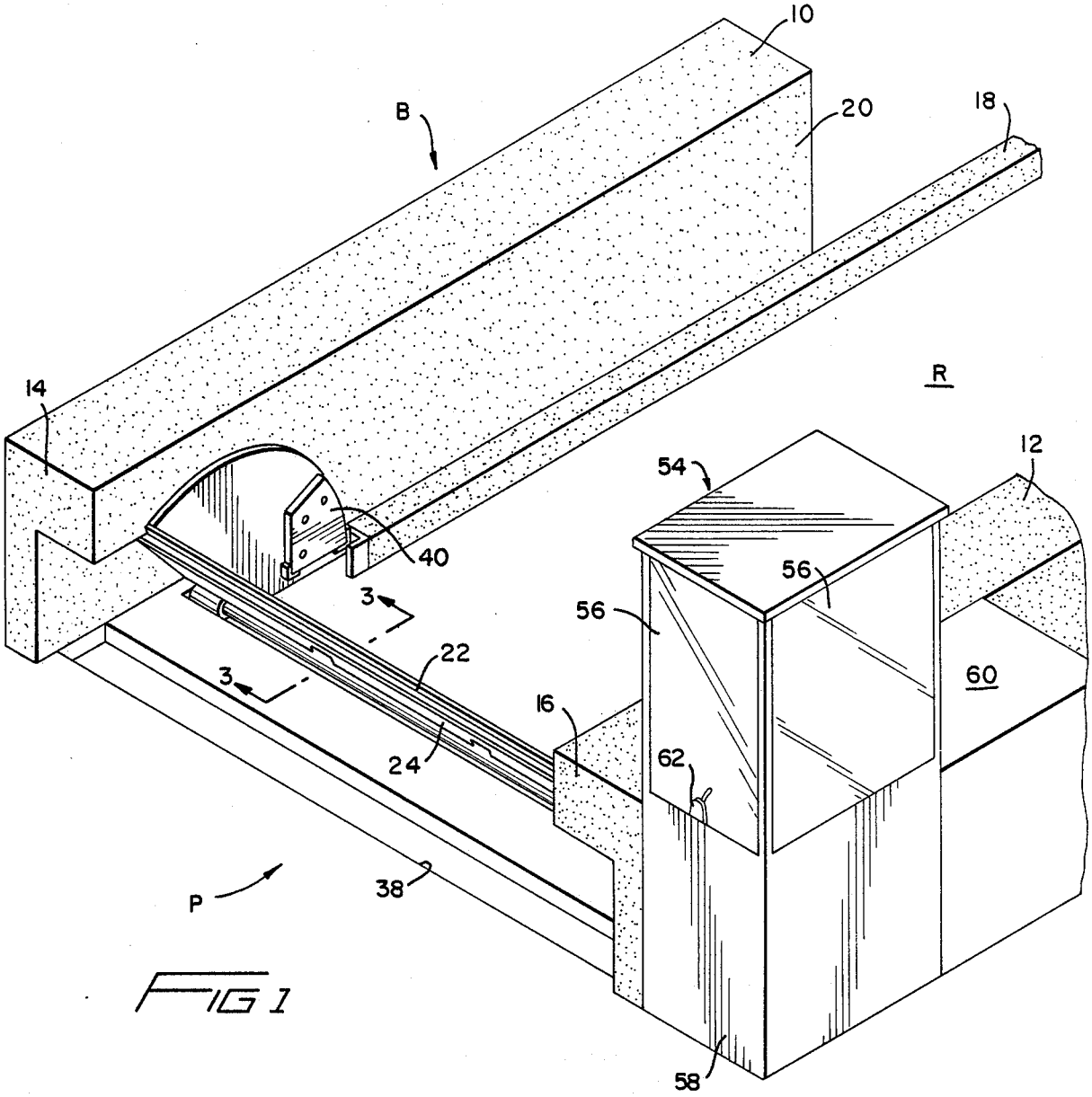
FIG. 1 is a perspective view illustrating an hydraulic barricade utilizing the hydraulic system of the invention.

Reinforced concrete abutment walls 10 and 12 are disposed along opposite sides of roadway R and define a passageway P therebetween. The abutment walls 10 and 12 have forward vehicle engaging surfaces 14 and 16, respectively. A concrete curb 18 extends along the walls 10 and 12, although only one curb 18 is shown in FIG. 1. Preferably, each of the concrete walls 10 and 12 has an inner substantially vertical sidewall, such as the sidewall 20 of FIG. 1. Although we have disclosed the abutment walls 10 and 12 as being comprised of reinforced concrete, various other such assemblies are possible, for example see U.S. Pat. No. 4,630,395, issued Dec. 23, 1986 to Ralph G. Nasatka for Portable Vehicle Barricade or Portable Maximum Security Barrier, the disclosure of which is incorporated herein by reference. Similarly, the shape of the abutment walls may be other than that shown.

Figure 3:
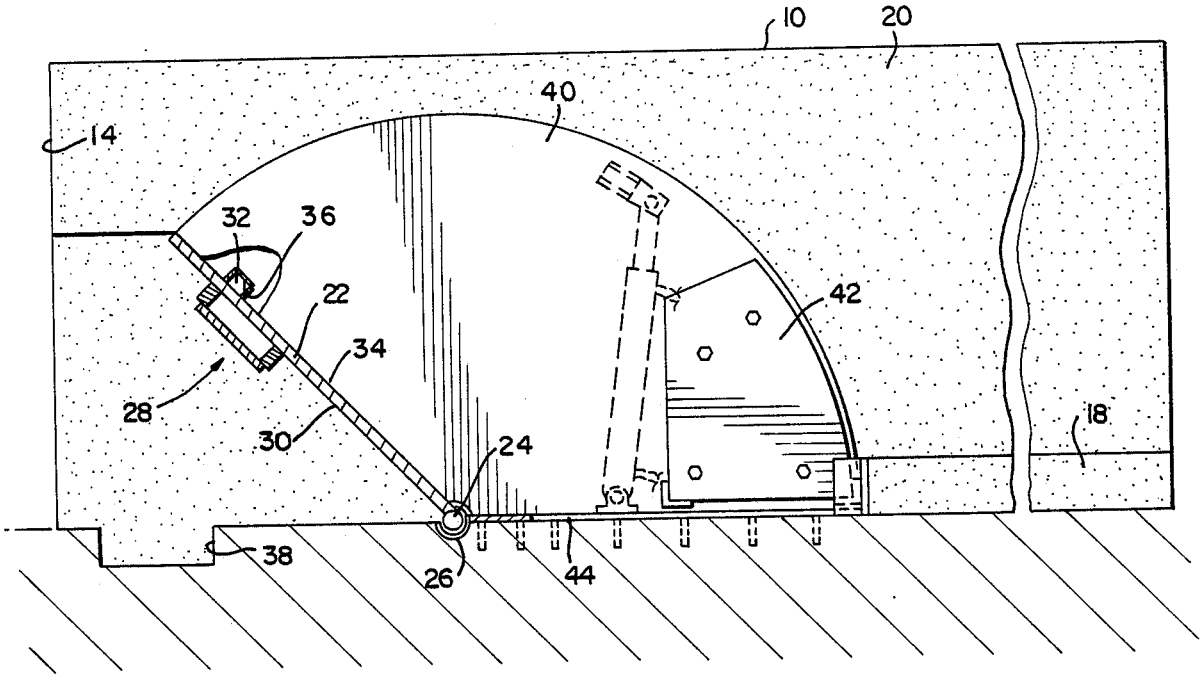
FIG. 3 is a fragmentary cross-sectional view of the barricade of the invention in the raised position.
Figure 4:
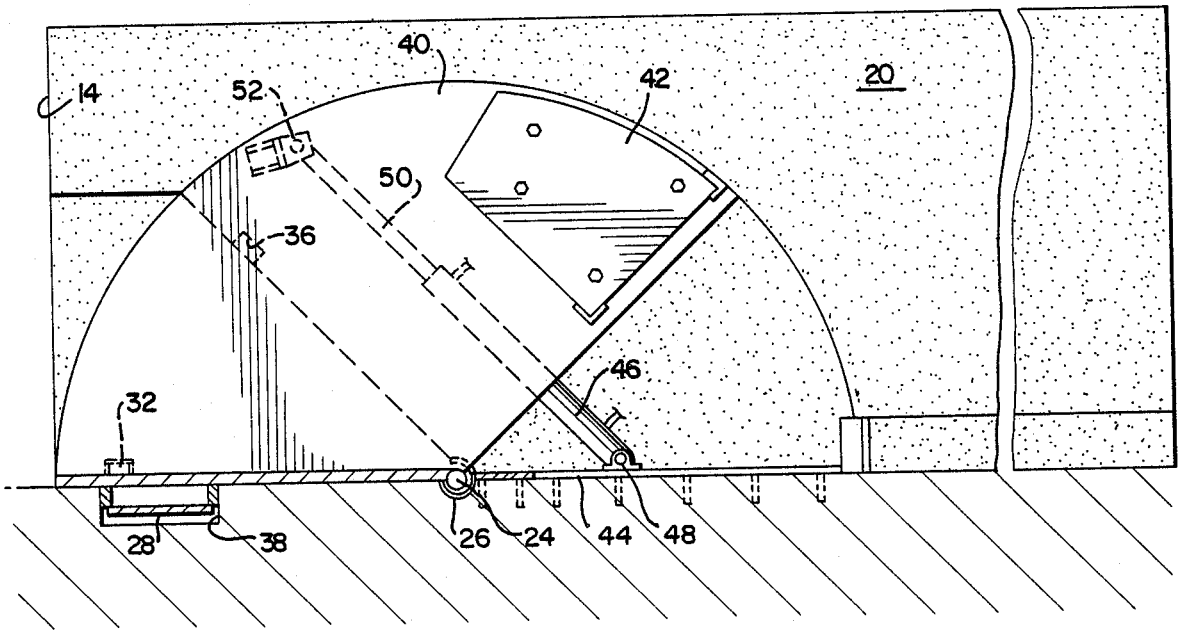
FIG. 4 is a fragmentary cross-sectional view illustrating the barricade of the invention in the lowered position; and, FIG. 5 illustrates a four-way two position solenoid controlled valve.

Steel barricade plate 22 is secured to shaft 24 disposed within bearing 26 extending across roadway R. The plate 22 preferably has box beam 28 welded to surface 30 thereof in order to provide additional support, as best shown in FIGS. 3 and 4. Stop 32 is welded to surface 34 thereof and is receivable in recess 36 to provide a positive stop preventing excessive rotation of the plate 22 on its axis 24. Preferably, the box beam 28 is receivable within recess 38 of roadway R so that the barrier plate 22 is parallel to the roadway R, when in the down position, permitting travel thereacross. Steel side plates 40 are secured to barrier plate 22 on opposite sides thereof and are rotatable therewith. Counterweights 42 are secured to side plates 40 and are rotatable therewith and permit the plate 22 to pivot easily, and minimize the force required to hold the plate 22 in the upward pivoted position. For further explanation of the barrier plate 22 and its related assemblies, see U.S. Pat. No. 4,574,523, issued Mar. 11, 1986 to Ralph G. Nasatka for Vehicle Barricade or Maximum Security Barrier, the disclosure of which is incorporated herein by reference.

Mounting plate 44 is secured to roadway R and extends rearwardly from shaft 24. Although only one mounting plate 44 is shown in FIGS. 3 and 4, those skilled in the art will understand that a corresponding mounting plate 44 extends rearwardly adjacent to each of the concrete walls 10 and 12 for like reason. Cylinder 46 is pivotally mounted to mounting plate 44 through pivot assembly 48. Piston 50 of cylinder 46 is likewise pivotally connected to side plate 40 through pivot assembly 52. In this way, extension and retraction of the pistons 50 will cause corresponding pivoting of the plate 22. Preferably, the cylinders 46 and pistons 50 are disposed between the walls 10 and 12 and the side plates 40 so that the side plates 40 act as a barrier preventing access thereto.

Operator booth 54, as best shown in FIG. 1, is disposed adjacent concrete wall 12 and includes glass windows 56. The windows 56 permit the operator (not shown) to have unrestricted view of the approach to barricade B so that the plate 22 can be pivoted as necessary. The windows 56 are preferably of bulletproof glass. Steel walls 58 provide positive securement for the operator when stationed in the booth 54. The hydraulic unit, which will be further described, is disposed adjacent booth 54 in housing 60. FIG. 1 discloses operating lever 62 which is used to control pivoting of the plate 22. Those skilled in the art will appreciate that additional mechanisms may be positioned within the booth 54 to facilitate operation of the barricade B.

Figure 2:
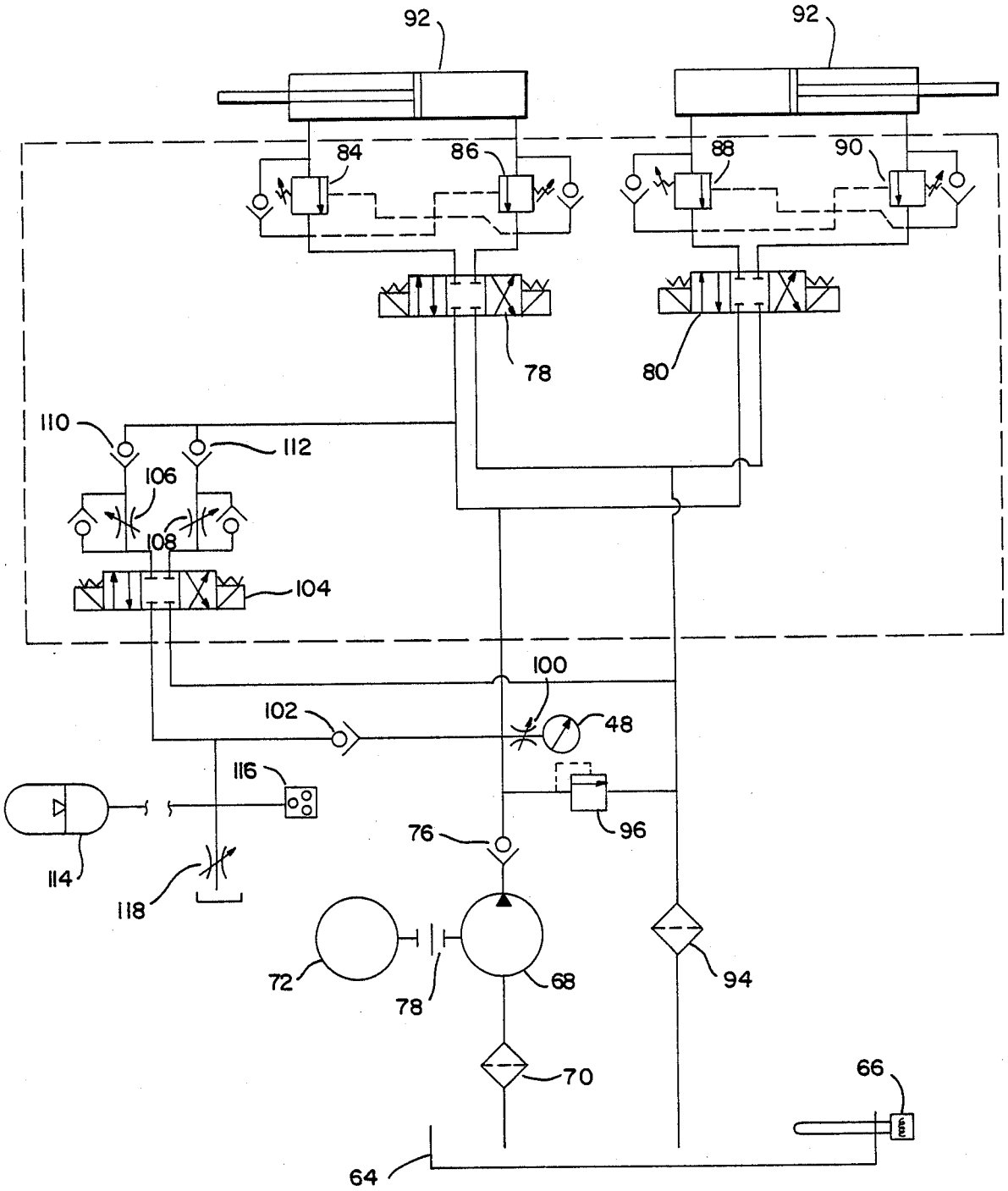
FIG. 2 is a schematic view of the hydraulic system of the invention.

Hydraulic fluid reservoir 64, as best shown in FIG. 2, is positioned within housing 60. The reservoir 64 preferably has a capacity of at least 10 gallons of hydraulic fluid and, also, preferably includes a sight gage to permit the volume to be monitored. An electric heating coil 66 is positioned within the reservoir 64 to maintain the fluid at a selected temperature, particularly when the barricade B is exposed to cold weather. The hydraulic fluid is preferably a petroleum based fluid, having a viscosity of 210 SSU at 100° F.

Positive displacement pump 68 communicates with the fluid in reservoir 64 through 100 mesh strainer 70. The pump 68 is, preferably, connected to electric motor 72 through coupling 74. The pump preferably has an output of 2600 PSI and is sufficiently sized to raise the barrier plate 22 to the up position in 6.5 seconds in normal operation, and 1.2 second in emergency situations. The pump 68 is sized to accomplish four complete cycles (up/down) per minute. Preferably, the motor 72 is a three horsepower, 1800 RPM 3-phase motor. Naturally, appropriate pipes, tubing and the like are provided to assure continuous fluid communication between the related parts of the hydraulic circuit, and further disclosure thereof is not believed required.

Check valve 76 is interposed between pump 68 and four-way two position directional control valves 78 and 80. Valve 76 prevents fluid from flowing backwardly through pump 68. The directional control valves 78 and 80 are, preferably, capable of being operated by an electric solenoid which also has an incorporated operable mechanical plunger, as will be further explained. Electrical and mechanical capability are preferred because of the need to shift the directional control valves 78 and 80 in the event of a power failure, as well as from the operator's booth 54 during normal operation.

Cylinder and piston assembly 82, which corresponds with the cylinder 46 and piston 50, is in flow communication with the directional control valve 78 through counterbalance valves 84 and 86. We prefer to use counterbalance valves because they provide an hydraulic brake for maintaining the barrier plate 22 in a pivoted position, and therefore resist the tendency of the plate 22 to downwardly pivot. Similar counterbalance valves 88 and 90 are in flow communication with directional control valve 80 for likewise operating on cylinder and piston assembly 92. The cylinder and piston assemblies 82 and 92 are, preferably, each disposed adjacent one of the concrete walls 10 and 12 in order to permit easy pivoting of the plate 22 and also to prevent the plate 22 from being bent as could occur if only one cylinder and piston assembly was utilized.

Return filter 94 is in flow communication with the directional control valves 78 and 80 for exhausting hydraulic fluid to the reservoir 64 during operation of the cylinder and piston assemblies 82 and 92. Preferably, pressure relief valve 96 interconnects the exhaust side of valve 76 with the reservoir 64 in order to vent fluid in an over pressure situation, such as could occur when the barrier plate 22 is struck by a vehicle. Gage 98 monitors the output of pump 68 as transmitted thereto through snubber 100. In this way, the operator of the hydraulic unit can make sure that the output of pump 68 is at the preselected level.

Check valve 102 is interposed between pump 68 and four-way two position directional control valve 104. The directional control valve 104 corresponds substantially with the valves 78 and 80 and includes an electrical solenoid operator having a manually operable mechanical plunger assembly. Flow control valves 106 and 108 lead to check valves 110 and 112, respectively, which ultimately lead to directional control valves 78 and 80. The valves 106 and 108 control the rate of pivoting of plate 22 in the power off condition. The check valves 110 and 112 prevent fluid from flowing from the directional control valves 78 and 80 to the directional control valve 104, while permitting fluid to flow from the directional control valve 104 to the directional control valve 78 and 80.

Hydraulic accumulator 114 is interposed between check valve 102 and directional control valve 104 in order to provide a secondary passive supply of pressurized hydraulic fluid. Pressure switch 116 monitors the pressure of accumulator 114 and operates the motor 72 whenever the pressure in the accumulator 114 fails below a selected level. In this way, the motor 72 need not be in continuous operation, but is operated only when required to provide primary power for operating the cylinder and piston assemblies 82 and 92, or when required to pressurize the accumulator 114. Preferably, a drain valve 118 is in flow communication with the accumulator 114 and with the reservoir 64 in order to permit the accumulator 114 to be drained as appropriate.

Figure 5:
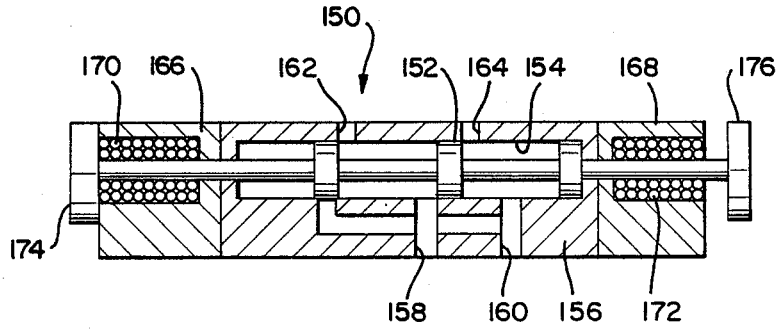

FIG. 5 discloses four-way two position valve assembly 150 which corresponds substantially to the valves 78, 80 and 104. Spool 152 is slidably mounted within chamber 154 of body 156. The body 156 has ports 158, 160, 162 and 164 through which hydraulic fluid flows in response to the position of spool 152.

C-frames 166 and 168 are mounted to the opposite ends of body 156. Electric coils 170 and 172 are mounted within the frames 166 and 168, respectively. Plungers 174 and 176 pass through the respective coils and are connected with spool 152. The coils 170 and 172 are operably connected with lever 62 and with a source of electric power. Energization of a coil generates a field causing the plunger and thereby the spool to shift for routing the fluid through the ports.

The plungers 174 and 176 may also be manually operated. In the event of a power failure, application of a force, such as by a screwdriver or the like, will cause the plunger to shift, and thereby the spool. Therefore, the valve assembly 150 may be remotely operated from the booth 54, or may be manually operated as required.

OPERATION

Operation of the barricade B is relatively straightforward because of the hydraulic system illustrated in FIG. 2. The pump 68 provides a primary source of pressurized hydraulic fluid which is normally utilized for pivoting the plate 22 as directed by the directional control valves 78 and 80. The directional control valves 78 and 80 are, preferably, operated by means of lever 62 in booth 54, although manual operation is possible through utilization of the incorporated mechanical plungers. The directional control valve 104, as well as the valves 78 and 80 are, preferably, operably connected to a single three station manifold which is positioned within housing 60, as is the accumulator 114, the motor 72, pump 68 and the reservoir 64. In this way, all operating components, with the exception of the cylinder and piston assemblies 82 and 92, are conveniently located within one housing, thereby facilitating manual operation.

The accumulator 114 provides a secondary passive source or pressurized hydraulic fluid which is only utilized in an emergency situation, such as terrorist attack or power failure. In the event of a terrorist attack, then the lever 62 is immediately moved to the emergency position, thereby permitting fluid to flow to the cylinder and piston assemblies 82 and 92 from the motor 68 and from the accumulator 114. In the emergency situation, the barrier plate 22 is immediately pivoted to the up position and is maintained there through the cooperative operation of the counterweights and the counterbalance valves. The barrier plate 22 will remain in the up position even should one of the hydraulic lines be ruptured, or the power disconnected.

The barrier plate 22 may also be pivoted through the action of the stored fluid in the accumulator 114 in the event that the power is somehow disabled. In a lost power situation, then the mechanical plungers of the directional control valves 78, 80 and 104 are depressed to the appropriate position for either raising or lowering the plate 22 as may be required. As noted, the directional control valves are all located on a single manifold, thereby permitting ready operation in a lost power situation.

The hydraulic circuit of FIG. 2 is also advantageous because the primary source of hydraulic fluid is permitted to communicate with the secondary source, while the secondary source does not communicate with the primary source. In other words, fluid may flow from the pump 68 and from the directional control valves 78 and 80 through the check valve 102 to thereby pressurize the accumulator 114, and absorb impact forces. The check valve 102 prevents fluid from flowing from the accumulator 114 to the primary power source, thereby assuring that the fluid in the accumulator is always available for emergency operation. Similarly, the check valves 110 and 112 only permit fluid to flow from the directional control valve 104 to the valves 78 and 80, and prevent fluid from flowing from the valves 78 and 80 into the secondary source. All fluid entering the accumulator must therefore pass through the check valve 102.

Those skilled in the art will understand that a two-way two position valve cannot normally be substituted for the four-way two position valve 104. A conventional two-way two position valve does not permit both manual and remote operation, and is therefore not totally practical for the intended use. The directional control valve 104 is capable of manual and remote operation from booth 54, thereby assuring that the barrier plate 22 may be raised regardless of what emergency conditon exists.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What we claim is:

1. Hydraulic barricade, comprising:

(a) support means;

(b) barricade means pivotally associated with said support means;

(c) at least a first hydraulic cylinder and piston assembly operably connected with said barricade means for pivoting said barricade means between an up and a down position;

(d) pump means as a primary source for supplying pressurized hydraulic fluid and for supplying pressurized hydraulic fluid to a secondary source;

(e) directional control valve means interposed between and in fluid communication with said cylinder and piston assembly and said sources for causing operation of said cylinder and piston assembly and thereby pivoting of said barricade means;

(f) first check valve means interposed between and in fluid communication with said sources for permitting pressurized fluid to flow from said pump means and said cylinder and piston assembly to said secondary source and for preventing fluid from flowing from said secondary source to said primary source;

(g) said secondary source including an hydraulic accumulator for storing hydraulic fluid under pressure; and (h) emergency valve means interposed between and in fluid communication with said secondary source and said directional control valve means for supplying fluid from said accumulator to said directional control valve means and said emergency valve means including a manual/remote operator for permitting selective operation thereof.

2. The barricade of claim 1, wherein:

(a) said emergency valve means including a four-way two position valve means.

3. The barricade of claim 2, wherein:

(a) said valve means includes an electrical solenoid and a plunger assembly, said solenoid permitting remote activation and said plunger assembly permitting manual activation.

4. The barricade of claim 1, and including:

(a) second check valve means interposed between and in fluid communication with said emergency valve means and said directional control valve means for preventing fluid from flowing from said directional control valve means to said emergency valve means and for permitting fluid to flow from said emergency valve means to said directional control valve means.

5. The barricade of claim 4, and including:

(a) flow control means interposed between and in fluid communication with said emergency valve means and said second check valve means for controlling the rate of pivoting of said barricade means.

6. The barricade of claim 1, and including:

(a) counterbalance valve means interposed between and in fluid communication with said directional control valve means and said cylinder and piston assembly for maintaining said barricade means at a pivoted position.

7. The barricade of claim 1, and including:

(a) pressure switch means operably associated with said secondary source and with said pump means for selectively operating said pump means and thereby maintaining said accumulator at a selected pressure.

8. The barricade of claim 7, wherein:

(a) said pump means being operably associated with a reservoir storing a supply of hydraulic fluid; and, (b) a drain valve operably associated with said secondary source and with said reservoir for permitting hydraulic fluid to be drained from said secondary source.

9. The barricade of claim 8, and including:

(a) a pressure relief valve being operably associated with said primary source and with said reservoir; and, (b) heater means being operably associated with said reservoir for maintaining the hydraulic fluid at a preselected temperature.

10. The barricade of claim 1, and including:

(a) another check valve means interposed between and in fluid communication with said pump means and said directional control valve means for preventing fluid from flowing from said sources to said pump means.

11. Hydraulic barricade, comprising:

(a) support means comprising first and second members disposed along opposite sides of a roadway for defining a passageway therebetween;

(b) barricade means pivotally associated with said support means and having oppositely disposed ends disposed adjacent said members;

(c) first and second hydraulic cylinder and piston assemblies, each of said assemblies operably connected with one of said ends and with said support means for pivoting said support means between an up and a down position;

(d) pump means operable associated with said assemblies and providing a primary source of pressurized hydraulic fluid for operating said assemblies and thereby causing pivoting of said barricade means;

(e) a passive secondary source of pressurized hydraulic fluid operably associated with said pump means and with said assemblies;

(f) first check valve means interposed between and in fluid communication with said sources for permitting fluid to flow from said primary source and from said assemblies to said secondary source and for preventing fluid from flowing from said secondary source to said primary source;

(g) first and second directional control valve means, each of said directional control valve means operably associated with one of said assemblies and with said sources for supplying pressurized fluid to said assemblies for causing selected pivoting of said barricade means; and, (h) emergency valve means interposed between and in fluid communication with said secondary source and said directional control valve means and including a manual/remote operator for permitting selected operation of said emergency valve means.

12. The barricade of claim 11, wherein:

(a) said emergency and directional control valve means each includes a four-way two position valve assembly having a plunger assembly permitting manual operation thereof and an electrical assembly permitting remote operation thereof; and, (b) second check valve means are interposed between and in fluid communication with said pump means, said secondary source and said directional control valve means for preventing fluid flow to said pump means.

13. The barricade of claim 11, wherein:

(a) a flow control valve means interposed between said emergency valve means and said directional control valve means for controlling the flow of fluid from said secondary source and thereby controlling the rate of pivoting of said barricade means; and, (b) first and second counterbalance valve means interposed between said directional control valve means and said cylinder and piston assemblies for maintaining said barricade means at a selected pivoted position.

14. The barricade of claim 11, wherein:

(a) said secondary source including an hydraulic accumulator for storing pressurized hydraulic fluid; and, (b) pressure switch means being operably associated with said secondary source and with said pump means for causing selective operation of said pump means for maintaining said accumulator at a selected pressure.

15. The barricade of claim 14, wherein:

(a) an hydraulic reservoir being operably associated with said pump means and with said directional control valve means for storing hydraulic fluid; and, (b) a pressure relief valve being interposed between said primary source and said directional control valve means and being operably associated with said reservoir.

16. The barricade of claim 13, wherein:

(a) third check valve means being interposed between said flow control valve means and said directional control valve means for preventing fluid from flowing from said directional control valve means to said flow control valve means.

17. The method of operating a pivotal barricade disposed across a roadway by means of an hydraulic system having a pump providing a primary source of motive power and an accumulator providing a secondary passive source of motive power and a directional control valve having a remote operator and a manual operator override thereof interposed between each of said sources and a cylinder and piston assembly which pivots the barricade and an emergency valve having a remote operator and a manual operator override thereof is interposed between the accumulator and the directional control valve and wherein fluid may flow from the primary source to the secondary source but not from the secondary source to the primary source, the method comprising the step of:

(a) causing pivoting of the barricade by any one of operating the directional control valve remote operator while the pump is operating and thereby causing selected pivoting of the barricade, operating the directional control valve and emergency valve remote operators in an emergency condition and thereby causing immediate pivoting of the barricade, and operating the directional control valve and emergency valve manual override operators while the pump is not operating and thereby deriving motive power from the accumulator.

18. The method of claim 17, including the step of:

(a) maintaining said barricade at a selected pivoted position while said pump is not operating by means of an hydraulic counterbalance valve means.

19. The method of claim 17, including the step of:

(a) controlling the rate of pivoting of said barricade when said emergency valve and directional control valve are manually operated by means of an hydraulic flow control valve.

20. The method of claim 17, including the step of:

(a) maintaining said accumulator at a selected pressure by means of a pressure switch operably associated with said accumulator and with said pump, said switch causing selective operation of said pump when the accumulator pressure is less than the selected pressure.

21. Hydraulic barricade, comprising:

(a) support means;

(b) barricade means pivotally associated with said support means;

(c) at least a first hydraulic cylinder and piston assembly operably connected with said barricade means for pivoting said barricade means between an up and a down position;

(d) pump means as a primary source for supplying pressurized hydraulic fluid and for supplying pressurized hydraulic fluid to a secondary source;

(e) directional control valve means interposed between and in fluid communication with said cylinder and piston assembly and said sources for causing operation of said cylinder and piston assembly and thereby pivoting of said barricade means;

(f) first check valve means interposed between and in fluid communication with said sources for permitting pressurized fluid to flow from said pump means and said cylinder and piston assembly to said secondary source and for preventing fluid from flowing from said secondary source to said primary source;

(g) said secondary source including an hydraulic accumulator for storing hydraulic fluid under pressure;

(h) emergency valve means interposed between and in communication with said secondary source and said directional control valve means for supplying fluid from said accumulator to said directional control valve means and said emergency valve means including a manual/remote operator for permitting selective operation thereof;

(i) second check valve means interposed between said emergency valve means and said directional control valve means for preventing fluid from flowing from said directional control valve means to said emergency valve means and for permitting fluid to flow from said emergency valve means to said directional control valve means; and (j) flow control means interposed between said emergency valve meanas and said check valve means for controlling the rate of pivoting of said barricade means.

22. Hydraulic barricade, comprising:

(a) support means comprising first and second members disposed along opposite sides of a roadway for defining a passageway therebetween;

(b) barricade means pivotally associated with said support means and having oppositely disposed ends disposed adjacent said members;

(c) first and second hydraulic cylinder and piston assemblies, each of said assemblies operably connected with one of said ends and with said support means for pivoting said support means between an up and a down position;

(d) pump means operably associated with said assemblies and providing a primary source of pressurized hydraulic fluid for operating said assemblies and thereby causing pivoting of said barricade means;

(e) a passive secondary source of pressurized hydraulic fluid operably associated with said pump means and with said assemblies;

(f) first check valve means interposed between said sources for permitting fluid to flow from said primary source and said assemblies to said secondary source and for preventing fluid from flowing from said secondary source to said primary source;

(g) first and second directional control valve means, each of said directional control valve means operably associated with one of said assemblies and with said sources for supplying pressurized fluid to said assemblies for causing selective pivoting of said barricade means;

(h) emergency valve means interposed between said secondary source and said directional control valve means and including a manual/remote operator for permitting selective operation of said emergency valve means;

(i) a flow control valve means interposed between said emergency valve means and said directional control valve means for controlling the flow of fluid from said secondary source and thereby controlling the rate of pivoting of said barricade means; and (j) first and second counterbalance valve means interposed between said directional control valve means and said cylinder and piston assemblies for maintaining said barricade means at a selected pivoted position.

* * * * *